US009650235B2

(12) United States Patent
Braden

(10) Patent No.: US 9,650,235 B2
(45) Date of Patent: May 16, 2017

(54) APPARATUS AND METHOD FOR TRANSFERRING DATA BETWEEN A FUEL PROVIDING MEANS AND A VEHICLE FOR THE PREVENTION OF MISFUELLING

(71) Applicant: ITCICO SPAIN, S.L., Palma de Mallorca (ES)

(72) Inventor: Jude Braden, Mallorca (ES)

(73) Assignee: ITCICO SPAIN, S.L., Palma de Mallorca (ES)

( * ) Notice: Subject to any disclaimer, the term of this patent is extended or adjusted under 35 U.S.C. 154(b) by 0 days.

(21) Appl. No.: 14/776,574

(22) PCT Filed: Mar. 14, 2014

(86) PCT No.: PCT/EP2014/000683
§ 371 (c)(1),
(2) Date: Sep. 14, 2015

(87) PCT Pub. No.: WO2014/139682
PCT Pub. Date: Sep. 18, 2014

(65) Prior Publication Data

US 2016/0023886 A1 Jan. 28, 2016

(30) Foreign Application Priority Data

Mar. 15, 2013 (EP) ..... 13380008

(51) Int. Cl.
*B67D 7/34* (2010.01)

(52) U.S. Cl.
CPC ..... *B67D 7/34* (2013.01); *B67D 7/348* (2013.01)

(58) Field of Classification Search
CPC ..... B67D 7/34; B67D 7/348; B67D 7/344; B67D 7/145

(Continued)

(56) References Cited

U.S. PATENT DOCUMENTS 4,263,945 A * 4/1981 Van Ness ..... B67D 7/348 137/234.6
5,605,182 A 2/1997 Oberrecht et al.
(Continued)

FOREIGN PATENT DOCUMENTS

GB 2 437 276 A 10/2007
JP 2005-153947 A 6/2005
WO WO-2008/053171 A1 5/2008

OTHER PUBLICATIONS

Search Report for PCT/EP2014/000683, mailed Jul. 7, 2014.

*Primary Examiner* — Timothy L Maust
*Assistant Examiner* — Timothy P Kelly
(74) *Attorney, Agent, or Firm* — Marshall, Gerstein & Borun LLP

(57) ABSTRACT

An apparatus and method for distinguishing the correct type of fuel to be disposed in a vehicle (4) is provided. The apparatus includes an RFID tag (40) disposed on one of a vehicle (4) or a fuel providing means (2), and a radio receiving means (42) disposed on the other of the vehicle (4) or fuel providing means (2). A signal, indicative of a type of fuel, is emitted by the RFID tag (40) and compared with a predetermined radio signal stored in a storage means (41), and a warning is generated on the basis of a determination of correspondence between the detected radio signal and predetermined radio signal. The present invention therefore provides a safe and reliable system that removes or reduces human decision from a refuelling process, and ensures the correct fuel is provided to the vehicle (4).

18 Claims, 8 Drawing Sheets

(58) Field of Classification Search
USPC ..... 141/94, 98, 351; 700/231
See application file for complete search history.

(56) References Cited

U.S. PATENT DOCUMENTS

| | | | | |
|---|---|---|---|---|
| 6,466,842 | B1 * | 10/2002 | Hartsell, Jr. ..... | B67D 7/145<br>141/94 |
| 8,261,784 | B2 * | 9/2012 | Gerard ..... | B67D 7/145<br>141/192 |
| 2009/0315729 | A1 * | 12/2009 | Inhoffer ..... | B64F 1/28<br>340/632 |
| 2012/0197460 | A1 * | 8/2012 | Seymour ..... | H01Q 1/22<br>701/1 |
| 2012/0305127 | A1 | 12/2012 | Roys et al. | |
| 2016/0012261 | A1 * | 1/2016 | Kelrich ..... | B67D 7/348<br>340/10.51 |

* cited by examiner

APPARATUS AND METHOD FOR TRANSFERRING DATA BETWEEN A FUEL PROVIDING MEANS AND A VEHICLE FOR THE PREVENTION OF MISFUELLING

FIELD OF THE INVENTION

The invention relates to the transferring of data between a fuel providing means and a vehicle during a fuelling process, such that misfuelling is prevented. Preferably, the invention provides an apparatus and method for performing the data transfer, wherein the data to be transferred corresponds to a fuel type and thereby ensures, via a comparison, that the correct fuel type is inserted into the vehicle.

BACKGROUND OF THE INVENTION

Vehicles often require a fuel in order to operate and typically require the replacing or insertion of such a fuel during extended use of the vehicle. Typically, a vehicle requires a specific type of fuel, and may, in fact, be converted to use various different types of fuel. Many vehicles are designed such that a user or driver may refuel the vehicle themselves, and many fuelling stations are currently provided to allow for such a refuelling process.

In order to cater for a plurality of different vehicles utilising different fuel types, a typical fuelling station may comprise several fuel providing means, such as fuel pumps, to any one user and vehicle. In other words, a vehicle is positioned in an appropriate location in the fuelling station for the refuelling to take place and a user is provided with a choice of different fuel dispensing means dispensing different fuel types at this location. Generally, the fuelling station is provided with a forecourt that contains the plurality of fuel providing means and allows for the vehicles to be positioned thereon in a correctly aligned and safe position for refuelling.

Therefore, a user is faced with a choice when it comes to selecting the correct fuel. Choosing the correct fuel is critical for the operation of a vehicle. Not only may an incorrect fuel cause inefficient or poor performance, but in some situations, an incorrect fuel may also cause damage to the engine or exhaust system of the vehicle, often leading to expensive and time consuming repairs. There is also a potential environmental cost in that fuel incorrectly inserted into a vehicle would also need to be reclaimed and disposed of in a safe manner according to legal regulations. Several methods and schemes are currently in place in order to aid the user in identifying and selecting the correct fuel type from the plurality of available fuel types.

For example, when considering an automobile, a typical fuelling station is provided with, at minimum, two fuel pumps corresponding to a petrol pump and diesel pump providing petrol and diesel fuels respectively. To distinguish the two, a colour-coded system may be employed such that, for example, the petrol pump is provided in one colour, e.g., green, and the diesel pump is provided in a different colour, e.g., black. In addition, or alternatively, the pumps may have other indicia, such as written labels or the like, to further aid the user in distinguishing the different fuel providing means. Therefore, a user may make a correct choice of fuel based upon these indicia.

However, the above described scheme does not account for a user not knowing or being aware of the correct fuel type of a certain vehicle, or from inadvertently selecting a wrong fuel type from the plurality of fuel pumps. For example, a user who is familiar with a petrol powered automobile may be provided with a diesel powered automobile, either as a new purchase or rental automobile. For the user, in this case, it becomes almost instinctual to select the petrol pump at the fuelling station. Indeed, the user may supply the automobile with the incorrect fuel type before realising they have done so, which may affect the performance of the automobile or even cause serious damage to the automobile.

A similar situation may occur at a fuelling station that provides skilled technicians to assist the user in the refuelling process, wherein the technician may insert the fuel into the vehicle. In this case, the technician may be unaware of the specific fuel type required for that vehicle, at least on first inspection. Thus, the technician is either forced to consult the user of the vehicle or to consult the operating manual for that vehicle. Both of these options add time and some inconvenience to a refuelling process.

A need exists, therefore, to provide a system or arrangement for identifying the correct fuel providing means at a fuelling station without relying purely on a human interaction, which introduces an inevitable element of human error into any refuelling process, and to provide a system that is able to operate safely and reliably.

One existing system utilises magnetic strips positioned on a fuelling pump. Specifically, US 2012/0305127 A1 describes the use of at least one magnet disposed on a nozzle of a fuel pump, wherein the nozzle of the fuel pump is fluidly connected to a pumping mechanism which supplies a certain fuel. In general, a vehicle fuel tank is typically provided with a fuel line which fluidly connects the fuel tank with a fuel tank opening positioned on the exterior of the vehicle and which is accessible to the user. When the opening is exposed, the nozzle of the fuel pump is able to be inserted therein and form a fluid path with the fuel tank. In the system of US 2012/0305127 A1, a sensor ring is disposed in the fuel line. The sensor ring includes a number of magnetic sensors, such as Hall sensors, which detect the presence of a magnetic field.

In this sense, magnetic strips are provided on one type of fuel pump, for example, a petrol pump, and the sensor ring is provided in the fuel line of, for example, a diesel powered automobile. Thus, when the nozzle of the petrol pump is inserted into the fuel tank opening of the diesel powered vehicle, a warning, such as illuminated LEDs, is provided when the sensor ring detects the magnetic field to let the user know that the incorrect nozzle is inserted.

The above described system also relies on a further existing technique to ensure that the correct fuel type is provided. Typically, the diameter of the nozzle of a fuel pump and the diameter of the opening of the fuel tank of a vehicle can be altered so as to avoid incorrect fuelling. As described in US 2012/0305127 A1, a nozzle of a diesel pump is typically larger than the nozzle of a petrol pump, thus meaning, if the openings of the corresponding fuel tanks are sized accordingly, that a diesel pump cannot be inserted into a petrol powered automobile. However, such systems still allows for a diesel vehicle to be misfuelled with petrol.

A further system, described in WO 2008/053171 A1, uses radio signals to distinguish between a diesel fuel and a petrol fuel. In this document, a transceiver is placed in the body of a vehicle, preferably in the boot or trunk thereof so as to be situated away from the fuel inlet. An aerial attached to the transceiver is preferably wrapped around the outer surface of the vehicle's fuel filler pipe. A reflective tag, which is described as being power-free, is positioned on a non-diesel fuel dispenser pump, either on a nozzle or handle thereof. Thus, the system distinguishes if a non-diesel fuel, e.g., petrol, is to be inserted into a diesel vehicle. In this regard, the system relies on already established techniques, such as the different sized nozzles and fuel tank openings discussed above, to prevent a diesel fuel from being inserted into a petrol vehicle. The system is also described as being a retrofit system, and is typically fitted to the wiring of the vehicle so as to draw power therefrom.

In operation, the transceiver continuously emits a radio signal at a specific frequency which passes through the body of the vehicle and to the reflective tag. The reflective tag then reflects the radio signal such that it returns to the transceiver and is detected. Thus, when the received radio signal is detected by the transceiver, the transceiver knows or determines that the fuel provided by the fuel dispensing pump is an incorrect fuel, i.e., not diesel, for the vehicle, and therefore the system prevents or halts a fuelling process. In contrast, when the radio signal is not detected, i.e., the reflective tag is not present, the system allows a fuelling procedure to commence or not be interrupted. In this regard, an alarm may also be provided, preferably an audio based alarm, which activates when the incorrect fuel is about to be inserted into the vehicle.

GB 2437276 A describes a system for preventing the inadvertent dispensing of the incorrect type of fuel into a vehicle fuel tank comprising an identifier device which is indicative of a first type of fuel and an electronic detector device, which is capable of determining the first type of fuel from a proximate identifier device. The detector device is capable of generating a signal if the first type of fuel is not of a predetermined type. The receiver unit includes an RFID receiver which is capable of interrogating an RFID tag on the fuel pump nozzle. The receiver unit is powered by a battery and includes a photodiode which activates the receiver unit when the receiver unit is exposed to light. This makes the whole system dependent on its activation by a photodiode, those light dependent diodes being very unreliable (especially during the night hours with artificial light) and very expensive.

The above described schemes and systems do not reliably provide a system that can readily account for an increasing number of fuel types. For instance, in today's market, a number of high performance fuels with differing octane ratings exist, as well as biofuels and the like. Only certain vehicles can operate with such fuels and thus a distinction between these fuels is required.

In addition, the above described schemes and systems can not reliably prevent the introduction of an incorrect fuel into the fuel tank of a vehicle; merely, they provide a warning which may or may not be ignored and/or missed by the user.

In light of the above, it is an object of the present invention to provide a method and an apparatus for reliably preventing the misfuelling of a vehicle.

SUMMARY OF THE INVENTION

The present invention provides an apparatus for transferring data between a fuel providing means and a vehicle for the prevention of misfuelling. The apparatus comprises an RFID tag which is adapted to emit a radio signal, and is disposed on one of the vehicle and the fuel providing means. The apparatus further includes a radio receiving means disposed on the other of the vehicle and the fuel providing means, and adapted to detect the radio signal emitted by the RFID tag. Storage means for storing a predetermined radio signal and determining means for comparing the detected radio signal with the predetermined radio signal and determining a correspondence thereof are also provided. An alarm unit is further provided, wherein the alarm unit is adapted to generate a warning signal on the basis of the correspondence, wherein the detected radio signal and the predetermined radio signal are each representative of a type of fuel.

The above described embodiment allows for the identification of a type of fuel to be inserted into a vehicle from a fuel providing means, and therefore enables the user to make a judgement on whether, or not, the correct fuel is being inserted into the vehicle, thereby avoiding misfuelling the vehicle. The above embodiment also has the advantage that the system is wireless and does not interfere with other processes taking place at an existing fuelling station or the like; for example, other communication processes.

A further embodiment also includes the RFID tag either integrally formed with the fuel providing means and the vehicle, or attachable to the fuel providing means and vehicle, and also includes the radio receiving means either integrally formed with the fuel providing means and vehicle, or attachable to the fuel providing means and vehicle.

In a preferred configuration, the RFID tag is disposed on one of a surface adjacent a fuel tank opening of the vehicle and a fuel dispensing means of the fuel providing means, and the radio receiving means is disposed on the other of the surface adjacent the fuel tank opening of the vehicle and the fuel dispensing means of the fuel providing means.

This embodiment allows for the easy retrofitting of the present invention to existing fuel providing means and vehicles, thereby also allowing for the easy replacement of components. It is an advantage that this embodiment does not require connection to the electrical system of a vehicle. Alternatively, this embodiment allows for the components to be provided as integral components of the fuel providing means and/or vehicle thereby increasing the structural rigidity and reliability of the system.

Yet another embodiment also provides the alarm unit further adapted to generate a warning signal which is one of: a visual based signal; a sound based signal; a visual and sound based signal; a vibration signal; a visual and vibration based signal; a sound and vibration based signal; and a visual, sound, and vibration based signal.

A further embodiment additionally provides the alarm unit with closing means and the warning signal further comprises a signal adapted to activate the closing means. The closing means may be adapted to, at least one of: close a fluid path between the fuel providing means and the vehicle, wherein the closing means includes at least one of a closing means located in the fluid path of the fuel providing means, and a closing means located in the fluid path of the vehicle; and switch off a pump of the fuel providing means.

This embodiment provides a physical block or prevention on the transfer of fuel, thereby meaning that the user simply cannot ignore the warning signals, as the user cannot refuel the vehicle until the correct fuel is provided.

Another embodiment also includes a switch that is provided in a holster of the fuel providing means wherein the switch is provided in a power providing circuit that provides power to at least one of the RFID tag and the radio receiving means disposed on the fuel providing means, such that the switch is adapted to control the supply of power to one of the RFID tag and radio receiving means. This enables the powering up of the selected fuel providing means, such that only that particular fuel providing means may be used in the determination of whether, or not, the correct fuel is provided.

Yet another embodiment also provides the RFID tag with a battery. This allows the RFID tag to transmit a radio signal without any dependence on external sources, i.e., the transmitting of the radio signal is not dependent on an interaction. This allows a fuelling process to be quicker as no delay is present waiting for components to activate. Additionally, this allows the RFID tag to be retrofit with its own power supply, rather than using an existing power supply.

A further embodiment also provides the radio receiving means with a passive power source, wherein the passive power source is adapted to provide power to the RFID tag via an interaction between the RFID tag and the passive power source when the passive power source is in range of the RFID tag. The passive power source provides power via an electromagnetic interaction, and does not require a physical connection. Such an arrangement conserves power as the RFID tag is only powered on when required, i.e., during fuelling.

Another embodiment additionally comprises fail safe means adapted to prevent the exchange of fuel between the fuel providing means and the vehicle if no radio signal is detected by the radio receiving means. The fuel providing means is adapted to switch from a deactivated state to an activated state when the detected radio signal and predetermined radio signal correspond. This enables only the correct fuel to enter the vehicle, and during a power failure or malfunction, does not allow any fuel to enter the vehicle.

Yet another embodiment also includes a manual override button, wherein the manual override button, when activated, is adapted to allow the transfer of fuel from the fuel providing means to the vehicle regardless of the correspondence.

A fuel station component of an apparatus according to the above embodiments is also provided and comprises a fuel dispensing means of the fuel providing means, which includes either the RFID tag for use with the radio receiving means or the radio receiving means for use with the RFID tag, for the transferring of data between the fuel dispensing means and a fuel tank opening of the vehicle.

A vehicle component of an apparatus according to the above embodiments is also provided and comprises a fuel tank opening of the vehicle, including either the RFID tag for use with the radio receiving means or the radio receiving means for use with the RFID tag, for the transferring of data between a fuel dispensing means of the fuel providing means and the fuel tank opening of the vehicle.

A further embodiment provides a kit to be used with the apparatus of one of the above embodiments, wherein the kit includes a plurality of vehicle fuel filler caps each including one or more RFID tags or one or more radio receiving means, wherein the plurality of vehicle fuel filler caps includes fuel filler caps of differing sizes suitable for retrofitting one of said fuel filler caps to an arbitrary vehicle.

Yet another embodiment of the present invention provides a method for the transfer of data between a fuel providing means and a vehicle for the prevention of misfuelling, comprising: a storing step for storing a predetermined radio signal, the predetermined radio signal containing data representative of a type of fuel; a transmitting step for transmitting a radio signal from at least one of the fuel providing means and the vehicle wherein the radio signal comprises data representative of a type of fuel; a detecting step for detecting the radio signal emitted by the at least one of the fuel providing means or the vehicle; a determining step for determining the correspondence between the detected radio signal and a predetermined radio signal; and a warning step for generating a warning signal on the basis of the determining step.

Furthermore, according to a further embodiment, if the determining step determines that the detected radio signal corresponds to the predetermined radio signal, fuelling is permitted, and, if the detected radio signal is different from the predetermined radio signal, the warning signal is generated.

Additionally, or alternatively, the method further comprises a closing means operation step, wherein the closing means operation step includes operating closing means in response to the warning signal, the closing means enabling at least one of the closing of the fluid path between the fuel providing means and the vehicle, and the switching of a pump of the fuel providing means to an off state. The closing means may include one or both of a closing means located in the fluid path of the fuel providing means, or a closing means located in the fluid path of the vehicle.

The present invention therefore provides a safe and reliable system that removes or reduces human decision from a refuelling process, and ensures the correct fuel is provided to the vehicle. Additionally, it is another aspect of the present invention to provide a system that may reduce the misalignment between a fuel providing means and a vehicle, such that spilling of a fuel is reduced.

BRIEF DESCRIPTION OF THE DRAWINGS

A better understanding of the features and advantages of the present invention will be obtained by reference to the following detailed description that sets forth illustrative embodiments by way of example only, in which the principles of the invention are utilised, and the accompanying drawings of which.

DETAILED DESCRIPTION OF THE INVENTION

Figure 1:
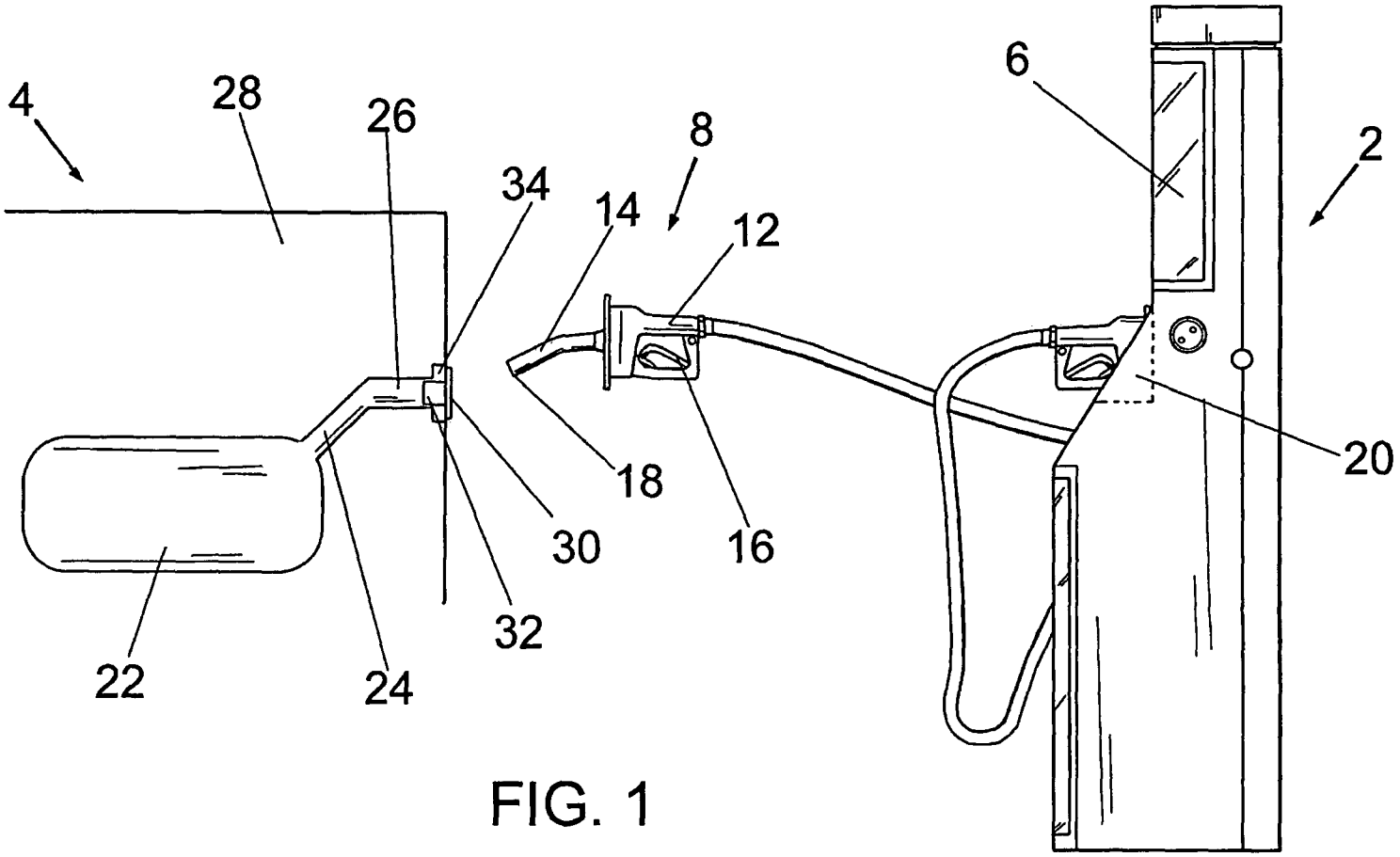
FIG. 1 shows a typical arrangement of a fuelling station and vehicle.

FIG. 1 shows a typical arrangement of an existing fuelling station. FIG. 1 shows both a fuel providing means 2 and a vehicle 4. A fuelling station typically comprises a number of fuel providing means 2 disposed on a forecourt, such that a number of vehicles 4 may be positioned on the forecourt and aligned for separate refuelling procedures. The fuel providing means 2 may be any sort of fuel providing means 2 and may provide any type of fuel. For example, the fuel providing means 2 may be a pump for pumping fluid fuel into a vehicle 4, or it may be a generator for supplying electricity to a vehicle 4. Essentially, the type of fuel is not limited. Equally, the vehicle 4 may be any type of vehicle operating on any type of fuel and may include an automobile, a motorcycle, or a heavy goods vehicle or the like. In addition, the vehicle 4 is not limited to land based vehicles and may include aircraft or maritime vehicles.

In the typical fuelling station shown in FIG. 1, a fuel providing means 2 may comprise a main body 6 which typically houses the components necessary for providing fuel and are dependent upon the type of fuel to be provided. The main body 6 is not limited to any particular shape or construction. For a fluid based fuel providing means 2, the main body 6 may be fluidly coupled to a reservoir or the like containing the fluid based fuel, and may include a pump that pumps the fluid based fuel from the reservoir to the main body 6 of the fuel providing means 2.

The fuel providing means 2 is provided with one or more fuel dispensing means 8 which are provided to connect the main body 6 of the fuel providing means 2 to the vehicle 4 such that fuelling may take place. The fuel dispensing means 8 may be coupled to the main body 6 via a fuel supply line 10. In the example of a fluid based fuel, the fuel dispensing means 8 is fluidly coupled to the main body 6 of the fuel providing means 2 via the fuel supply line 10. In this example, the fuel supply line 10 may be positioned externally to the main body 6. For an electric based fuel providing means 2, the fuel supply line 10 may be internal or external to the main body 6 and connect to the fuel dispensing means 8, wherein the fuel dispensing means 8 may be arranged as a socket (not shown) on the surface of the main body 6, for example.

The fuel dispensing means 8 may include a handle 12 and a nozzle 14. The handle 12 is designed such that a user of the fuel providing means 2 may hold and manoeuvre the fuel dispensing means 8. Herein, the term user may refer to a user or driver of the vehicle 4 or to a forecourt technician or the like, but generally refers to an operator of the fuel dispensing means 8. The nozzle 14 of the fuel dispensing means 8 generally a tube or pipe and is connected to the fuel supply line 10. In this regard, the nozzle 14 may extend through the handle 12 and connect directly to the fuel supply line 10, or the nozzle 14 may be connected to the handle 12 which in turn is connected to the fuel supply line 10. For a fluid based system, the nozzle 14 is fluidly connected to the fuel supply line 10 such that fuel may flow from a reservoir to the nozzle 14. Herein, the nozzle 14 is not limited to a tube or the like, but may also encompass the pins of an electric plug, for example, or an electric socket.

The nozzle 14 is typically inserted into the vehicle 4 such that fuel may be supplied to the vehicle 4. The fuel dispensing means 8 may also be provided with a trigger 16, wherein the trigger 16 is operated by the user to control the provision of fuel. For example, when the trigger 16 is compressed, a signal may be sent to the main body 6 of the fuel dispensing means 2 to initiate the supply of fuel to the vehicle 4.

As shown in FIG. 1, the nozzle 14 is provided with a fuel outlet 18 which is the point at which fuel leaves the nozzle 14. In the case of a fluid based system, the nozzle 14 may comprise the tube, typically of a metal material, which further comprises an open end acting as a fuel outlet 18.

Typically, the main body 6 of the fuel providing means 2 may be provided with a storage section for storing the fuel dispensing means 8 when not in use. As shown in FIG. 1 by the dashed line, a holster 20 is provided for inserting the handle 12 and nozzle 14 of the fuel dispensing means 8 into the main body 6.

A typical, fluid fuel based system may employ a switch (not shown) located in the holster 20, such that the movement of the fuel dispensing means 8, i.e., the withdrawal or insertion from/into the holster 20, changes the state of the switch. For example, when the fuel dispensing means 8 is inserted into the holster 20, the switch may be in a state to disengage the pump of the fuel providing means 2. Equally, when the fuel dispensing means 8 is removed from the holster 20, the switch may be in a state to engage the pump of the fuel providing means 2. In such an arrangement, the trigger 16 controls the release of the fluid fuel from the nozzle 14.

The vehicle 4 includes a fuel tank 22 for storing the supplied fuel. The fuel tank 22 may be adapted to store any kind of fuel provided by the fuel providing means 2. For example, the fuel tank 22 may be a container for storing fluid, or may be a capacitor or battery for storing electrical charge. Additionally, the fuel tank 22 may be adapted to chemically store fuel, for example, as in hydrogen cells or the like.

The fuel tank 22 may be provided with a fuel line 24, wherein the fuel line 24 is provided with a fuel tank opening 26. The fuel tank opening 26 is generally provided on the surface of a body 28 of the vehicle 4. The fuel tank 22 may then be coupled to the outside of the vehicle 4, and thus an easily accessible location for the user, via the fuel line 24 and the fuel tank opening 26. The fuel line 24 may by fluidly coupled to the fuel tank 22 and may comprise a hollow tube or the like. The fuel line 24 may alternatively comprise electrical wires, in the case of an electric based fuel providing means 2. In the case where a socket is provided on the surface of the main body 6 of the fuel providing means 2, the fuel line 24 may be extendible from the body 28 of the vehicle 4, and may include an electrical plug as the fuel tank opening 26.

The fuel tank opening 26 may be indented slightly with regards to the surrounding portions of the body 28 of the vehicle 4 so as to accommodate a fuel filler cap 30. In this case, the outer surface of the fuel filler cap 30, when closed, may be arranged to be substantially flush with the body 28 of the vehicle 4. The fuel filler cap 30 may also comprise a stopper 32 which is inserted in the fuel tank opening 26 so as to seal off the fuel line 24 and fuel tank 22 thereby preventing dust and the like from entering the fuel tank 22. The fuel filler cap 30 may be integrally formed with the stopper 32, or the stopper 32 may be provided as a separate component.

Therefore, in a refuelling process, if the fuel filler cap 30 and stopper 32 are integrally formed, the fuel filler cap 30 and stopper 32 are removed from the vehicle 4 so as to expose the fuel tank opening 26. Equally, if the fuel filler cap 30 and stopper 32 are separately formed, the fuel filler cap 30 is first removed from the vehicle 4 and then the stopper 32 is removed from the vehicle 4 so as to expose the fuel tank opening 26. In both cases, the fuel filler cap 30 may be provided with a hinge and be hinged to the body 28 of the vehicle 4 or may be provided as a separate component from the body 28.

According to the above arrangement, a surface 34 surrounding the tank opening 26 may be provided. In some configurations, a hollow space or gap is provided when the fuel filler cap 30 is positioned to close the fuel tank opening 26. Other arrangements allow for the fuel filler cap 30 to be positioned flush against the surface 34.

Typically, the fuel tank 22 is connected to a motor or engine (not shown) such that the acquired fuel may be provided to the motor or engine to thereby generate power for the vehicle, and thus enable the vehicle to move.

In a standard fuelling process according to the system described above and highlighted in FIG. 1, the vehicle 4 is positioned in close proximity to the fuel providing means 2, wherein the fuel filler cap 30 and stopper 32 are removed to thereby expose the fuel tank opening 26. The user (either user of the vehicle or forecourt technician) selects an appropriate fuel dispensing means 8 from one of a plurality of fuel dispensing means 8 and moves the selected fuel dispensing means 8 towards the vehicle. When the fuel dispensing means 8 is removed from a holster 20, a pump or the like may engage via activation of the switch.

The nozzle 14 of the fuel dispensing means 8 may then be inserted into the fuel tank opening 26 and extend part way down the fuel line 24. At this point, the vehicle 4 and the fuel providing means 2 are temporarily connected via a pathway including the nozzle 14, the fuel supply line 10, the fuel line 24, and the fuel tank 22. The user may then compress the trigger 16 to initiate the supply of fuel from the fuel providing means 2 to the fuel tank 22 of the vehicle 4.

Once fuelling is complete, the trigger 16 is released, the nozzle 14 withdrawn from the fuel line 24 and fuel tank opening 26, and the fuel dispensing means 8 returned to the holster 20 of the fuel providing means 2. The pump may disengage once the fuel dispensing means 8 is returned to the holster 20. The user may then replace the fuel filler cap 30 and stopper 32.

As is the case with traditional fuel providing means 2, a display or the like may be provided so as to indicate the level of fuel currently supplied to, or being supplied to, the vehicle 4. Other indicia for distinguishing the fuel providing means 2, such as numbers or letters, may also be provided.

The present invention provides a system for indentifying the correct fuel dispensing means 8 for a certain vehicle 4 selected from a plurality of fuel dispensing means 8 located at any fuel providing means 2. Several arrangements are described herein for further understanding of the present invention. The arrangements described should not be construed as limiting the present invention.

Figure 2:
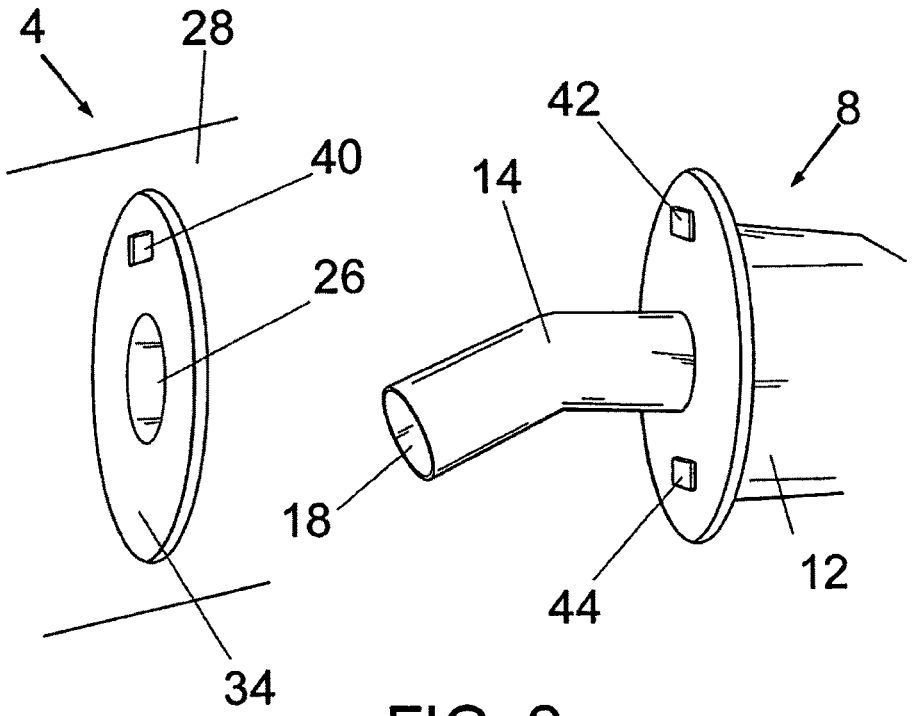
FIG. 2 shows a close-up view of the arrangement of an RFID tag and radio receiving means according to an embodiment of the present invention.
Figure 3:
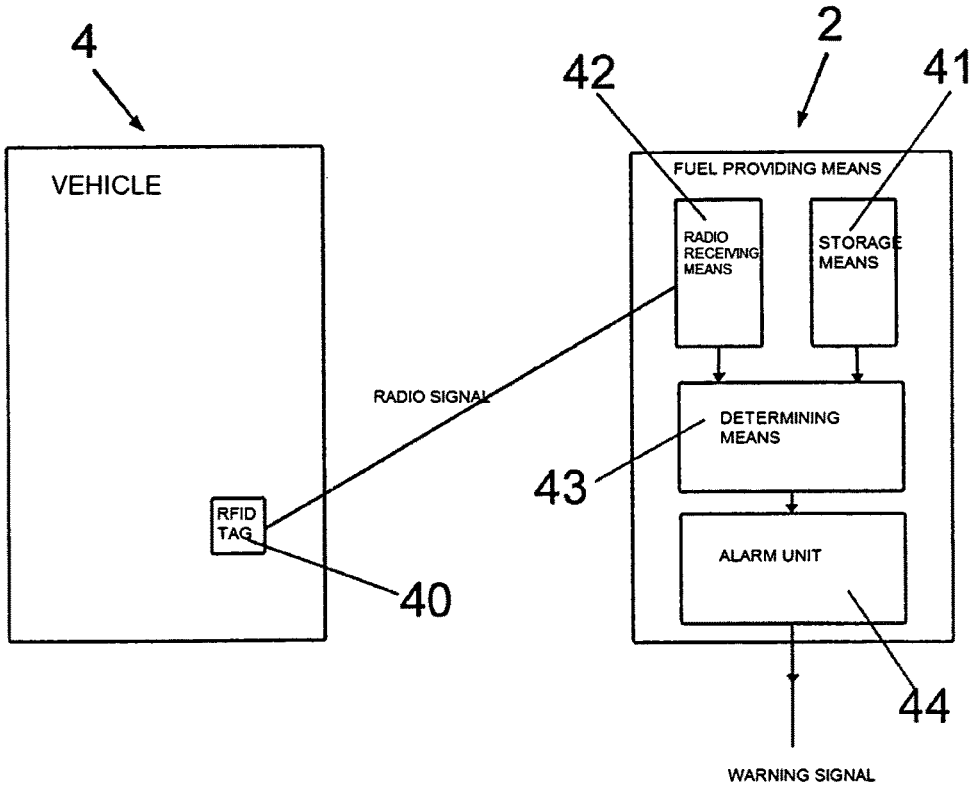
FIG. 3 shows a block diagram representation of the arrangement according to FIG. 2.

FIGS. 2 and 3 show one possible arrangement of the present invention. FIG. 2 shows a close-up version of a section of the vehicle 4 and fuel dispensing means 8 of a fuel providing means 2. FIG. 3 shows a functional block diagram representation of the arrangement of FIG. 2. Like components from the discussion above use the same numerals, and a description thereof is not repeated and thus omitted.

In the arrangement depicted in FIGS. 2 and 3, the vehicle 4 is provided with a Radio Frequency ID tag 40, herein RFID tag 40. The RFID tag 40 is a wireless based system and includes a transmitter that is adapted to transmit data from the RFID tag 40, as a radio signal. Existing RFID tags 40 can operate from around 120 kHz up to 10 GHz depending upon their intended use and design specification. The RFID tag 40 may include a memory for storing data including data representative of the radio signal.

The radio signal is preferably representative of the type of fuel that the vehicle 4 requires. For example, a radio signal of 300 kHz may correspond to a petrol powered automobile, while a radio signal of 500 kHz may correspond to a diesel powered automobile. The data is conveyed in the form of a frequency in this exemplary situation. Alternatively, the data may be conveyed as a modulation of a radio signal.

The RFID tag 40 is selected based on the requirements of the vehicle 4, or the RFID tag 40 is programmable. That is, an RFID tag 40 that emits a fixed radio signal is selected from a plurality of RFID tags 40 that emit different signals and integrally formed or affixed to the vehicle 4 corresponding to a certain fuel type. Alternatively, a general RFID tag 40 is integrally formed or affixed to the vehicle 4 and programmed to emit a certain frequency radio signal corresponding to a certain fuel type from a range of radio frequencies. With a programmable RFID tag 40, the RFID tag 40 may be reprogrammed at a later time; for example, when a vehicle 4 is upgraded to operate with a different fuel, such as a biofuel.

The location of the RFID tag 40 is not limited to the location shown in FIG. 2. Indeed, the RFID tag 40 may be placed on the surface 34 surrounding the fuel tank opening 26, as shown in FIG. 2, but it may also be located on the body 28 of the vehicle 4 or located in the fuel line 24 of the vehicle, either on the outer or inner surfaces thereof or integrally formed therewith. That is, the RFID tag 40 does not necessarily need to be located on an outer surface of the vehicle 4, but may be located internally to the vehicle 4.

In a corresponding manner, the fuel providing means 2 in FIG. 2 is provided with a radio receiving means 42, which is adapted to detect the emitted radio signal from the RFID tag 40. As with the RFID tag 40, the location of the radio receiving means 42 is not limited to the location shown in FIG. 2. The radio receiving means 42 may be located at any position on the fuel dispensing means 8, such as the handle 12 or nozzle 14. FIG. 2 shows the radio receiving means 42 disposed on the handle 12 of the fuel dispensing means 8. Additionally, the radio receiving means 42 may be located on the main body 6 of the fuel providing means 2 or on the fuel supply line 10. Further, the radio receiving means 42 may be located internally to any of the abovementioned components (i.e., nozzle 14, handle 12, fuel supply line 10, or main body 6). The radio receiving means 42 may detect the radio signal emitted by the RFID tag 40 at any given orientation of the radio receiving means 42 or polarisation of the radio signal, provided that the RFID tag 40 is within range of the radio receiving means.

The RFID tag 40 and the radio receiving means 42 may be supplied as separate components that can be retrofitted to an existing system. For example, the RFID tag 40 and radio receiving means 42 may be provided with fixing means, such as adhesive, for example, which enable the RFID tag 40 and radio receiving means 42 to be affixed to the vehicle 4 and fuel providing means 2 respectively. This may also allow for the removal of the RFID tag 40 and radio receiving means 42 from the vehicle 4 and fuel providing means 2 respectively, should any one of the components need replacing due to error or malfunction. Providing such a simple retrofit system allows an unskilled user to fit the system with relative ease and precision.

Alternatively, the RFID tag 40 and the radio receiving means 42 may be integrally formed with the corresponding components. That is, the RFID tag 40 may be integrally formed with the vehicle 4 while the radio receiving means 42 may be integrally formed with the fuel providing means 2. Equally, any combination of integrally formed and separately provided components is considered. For example, the RFID tag 40 may be integrally formed with the vehicle 4 and the radio receiving means 42 may be separately provided and affixed to the fuel providing means 2.

Alternatively, the RFID tag 40 may be provided as a separate component and affixed to the vehicle 4 and the radio receiving means 42 may be integrally formed with the fuel providing means 2.

As shown in FIG. 3, a storage means 41 is also provided. The storage means 41 is adapted to store a predetermined radio signal which, as defined later, is used to determine if the correct fuel is to be inserted into the vehicle 4. The storage means 41 may be provided as a separate component and affixed to or formed integrally with the fuel providing means 2. In a preferred arrangement, the storage means 41 is provided integrally with the radio receiving means 42 or with an alarm unit 44 (defined later). The exact location of the storage means 41 is not limited and the storage means 41 may be provided with any form of communication means to communicate with the radio receiving means 42 and a determining means 43. Indeed, the storage means 41 may be provided in a remote location, and simply communicate the predetermined radio signal to the determining means 43. The storage means 41 may include any type of data storage means such as computer readable memory or the like.

The determining means 43, as shown in FIG. 3, receives the predetermined radio signal from the storage means 41. In addition, the determining means 43 receives the detected radio signal from the radio receiving means 42, i.e., the radio signal emitted from the RFID tag 40. The determining means 43 compares the radio signal and the predetermined radio signal and determines a correspondence. That is, the determining means 43 determines the degree of similarity between the radio signal and the predetermined radio signal.

As with the storage means 41, the location of the determining means 43 is not limited. The determining means 43 may be provided as a separate component and affixed to, or integrally formed with, the fuel providing means 2. As with the storage means 41, the determining means 43 is provided with any form of suitable communication means so as to communicate with the radio receiving means 42 and storage means 41. In a preferred arrangement the determining means 43 is provided integrally with the radio recovering means 42 or the alarm unit 44. In addition, the storage means 41 and determining means 43 may be integrally formed as one component and communicate with the radio receiving means 42 and alarm unit 44. Additionally, either one of the components may be integrally formed with the radio receiving means 42 and the alarm unit 44. One arrangement may include the radio receiving means 42 integrally formed with the storage unit 41, and the alarm unit 44 integrally formed with the determining means 43. An advantageous arrangement is that the radio receiving means 42, storage means 41, and determining means 43 are all integrally formed as one component.

The alarm unit 44 may be provided as a separate component or integrally formed with one of the vehicle 4 and fuel providing means 2. Additionally, the alarm unit 44 may be integrally formed with the RFID tag 40 or radio receiving means 42. Furthermore, the alarm unit 44 may be located at a remote location, other than where the fuelling is taking place, and communicate with the RFID tag 40, radio receiving means 42, storage means 41, and/or determining means 43.

Figure 4:
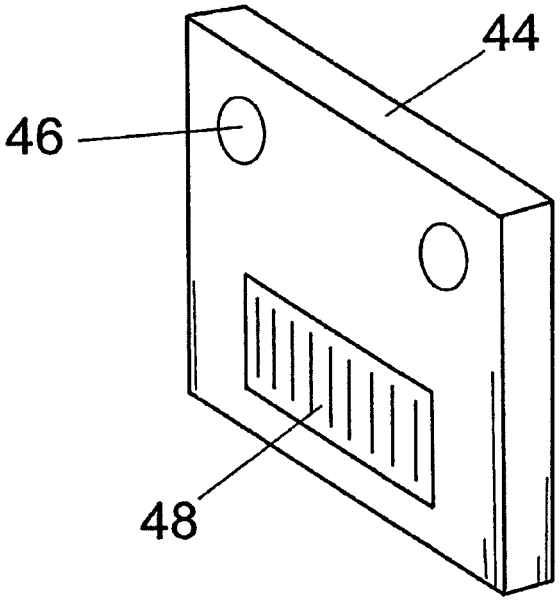
FIG. 4 shows an exemplary configuration of an alarm unit including various indicators.

The alarm unit 44 is provided with warning means to provide a warning signal on the basis of the determination of correspondence from the determining means 43. The warning means may include one or more visual indicators 46 or one or more sound indicators 48. FIG. 4 shows an exemplary arrangement of the alarm unit 44 containing both visual 46 and sound indicators 48. For example, the visual indicator 46 may include an LED or equivalent light emitting component that is illuminated to provide a warning. The sound indicator 48 may include a buzzer or amplifier or the like, which produces a sound based warning signal on the basis of the determination of correspondence.

Further, the alarm unit 44 may include a vibration indicator which is adapted to produce a vibration on the basis of the determination of correspondence. For example, the alarm unit 44 may be fitted to, or integrally formed with, the fuel dispensing means 8, and more preferably, with the handle 12 of the fuel dispensing means 8. A motor or the like may also be provided in the handle 12 of the fuel dispensing means 8, such that the motor operates when instructed by the alarm unit 44, thereby causing a vibration to pass through to the user as the warning signal. In utilising a vibration indicator, a user is less likely to misread, or simply not notice, a vibration based warning.

The alarm unit 44 may employ one or more of the abovementioned warning indicators. That is, the alarm unit 44 may include all or any combination of: one or more visual indicators 46, one or more sound indicators 48, or one or more vibration indicators. Therefore, the warning signal may comprise any one of: a visual based signal; a sound based signal; a visual and sound based signal; a vibration based signal; a visual and vibration based signal; a sound and vibration based signal; or a sound, visual, and vibration based signal. Furthermore, the indicators are not limited to being formed integrally with the alarm unit 44 as shown in FIG. 4, and may, in fact, be positioned remotely from the alarm unit 44. In this case, the indicators may communicate wirelessly with the alarm unit 44 to activate. Moreover, the indicators do not have to be positioned on one or the other of the vehicle 4 or the fuel providing means 2, but may be located on a combination of the vehicle 4 and fuel providing means 2.

The alarm unit 44 is provided with suitable means to communicate with the determining means 43, which may be any appropriate communication means. For example, this could include physically connecting the alarm unit 44 to the determining means 43 via electric wires or the communication link could be wireless. This communication link may be a one or two-way link, such that the alarm unit 44 may communicate with the determining means 43.

The RFID tag 40 or the radio receiving means 42 may be provided with a power source or the like. In standard terminology of the field, an RFID tag 40 supplied with a power source is deemed to be "active". For example, the RFID tag 40 may be supplied with a battery or may be connected to the power source of the vehicle 4.

Additionally, the radio receiving means 42 may also be provided with a battery or may be connected to the power source of the fuel providing means 2. Finally, the alarm unit 44 (and warning means) may also be provided with a battery or may be connected to the power source of the vehicle 4 and/or the fuel providing means 2. Additionally, the storage means 41 and determining means 43 may also be provided with a power source, if deemed appropriate, or could be linked to a power source of a different component. The power of the abovementioned components may be provided via a power providing circuit which is either an individual circuit for each component or a linked circuit that links multiple components. The power providing circuit may include a power source which may be any one of a battery, a main power supply, or means for receiving passive power.

Additionally, or alternatively, the radio receiving means 42 may be supplied with a passive power supply in the power providing circuit which is adapted to passively provide power to the RFID tag 40 via an electromagnetic interaction. In such an arrangement, the RFID tag 40 does not require a battery (RFID tag 40 is deemed to be in a "passive" state) and does not transmit the radio signal until the RFID tag 40 is exposed to the electromagnetic interaction from the passive power supply. In a preferred arrangement, the radio receiving means 42, provided with a power supply from the fuel providing means 2, activates the RFID tag 40 when the RFID tag 40 is in a certain range of the radio receiving means 42. In other words, the RFID tag 40 is inactive until the radio receiving means 42, preferably disposed on the fuel dispensing means 8, is moved within a certain range of the RFID tag 40 such that power can be transferred from the passive power supply.

In general, the RFID tag 40 has a certain transmitting range R at which a radio signal propagating from the RFID tag 40 is detectable to, i.e., detectable by the radio receiving means 42. In a preferred arrangement, the transmitting range R of the RFID tag 40 is set to be low, less than a meter or so. In another arrangement, the transmitting range may be 80 cm or less, or more preferably, 50 cm or less. This enables the RFID tag 40 of a vehicle to not interfere with the adjacent fuel dispensing means 8, either of the same fuel providing means 2 or an adjacent fuel providing means 2. That is, preferably, the radio receiving means 42 of the fuel providing means 2 is not in the transmitting range R of the RFID tag 40 at rest and must be moved towards the RFID tag 40 before any detection of a signal can be undertaken.

Additionally, a different range, a passive power range, may be present regarding the passive power system. The passive power range is the range over which power may be supplied to the RFID tag 40 and may be larger, smaller, and/or equal to the transmitting range R. This enables a configuration whereby the radio signal is not transmitted until the RFID tag 40 is within the passive power range, as the RFID tag 40 is not provided with power until such a time. This configuration means that power is conserved and reduces the chance of interference from neighbouring vehicles 4.

Figure 5:
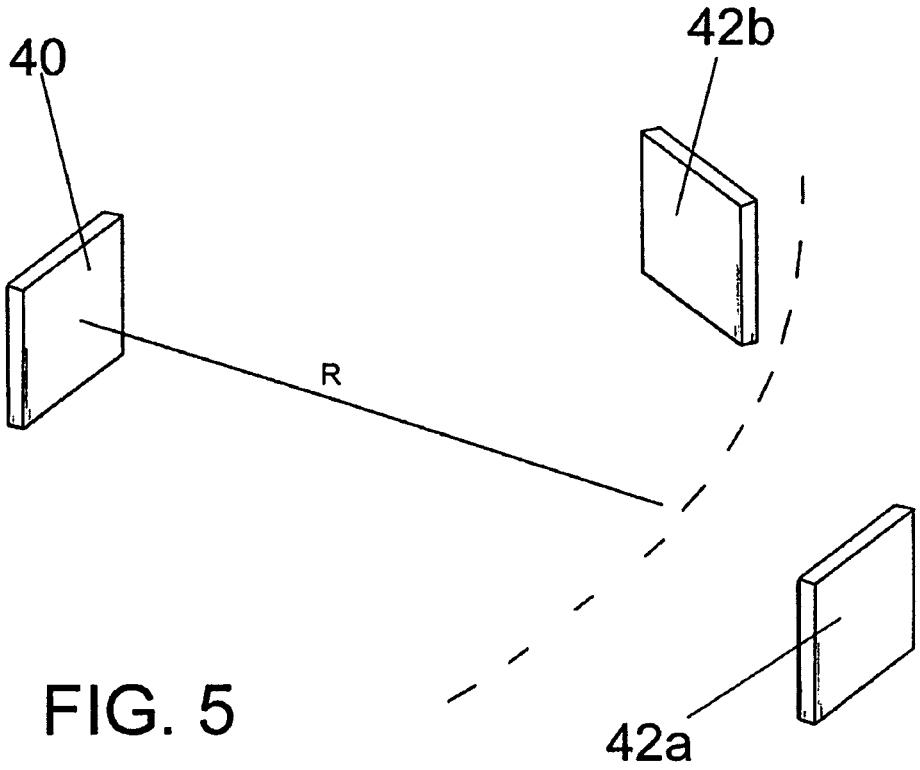
FIG. 5 shows an arrangement of a plurality of radio receiving means in relation to a transmitting range of an RFID tag.

FIG. 5 depicts a situation involving a transmitting range R, wherein an RFID tag 40 is shown with the transmitting range R. Two radio receiving means 42*a*, 42*b* are provided, wherein radio receiving means 42*b* is within transmitting range R and thus detects the radio signal from the RFID tag 40. Radio receiving means 42*a* is not within the transmitting range R and thus does not receive the radio signal—the radio signal is not detected by the radio receiving means 42*a*. Thus, radio receiving means 42*a* does not interfere with the fuelling process using radio receiving means 42*b*, which may be attached to the movable fuel dispensing means 8.

In an alternative arrangement, the range of the RFID tag 40 may be set to 20 cm or less, or more preferably 2 cm or less, wherein the radio receiving means 42 is disposed on the handle 12 or nozzle 14 of the fuel dispensing means 8. In this configuration, the nozzle 14 of the fuel dispensing means 8 must be fully, or very nearly, inserted into the fuel tank opening 26 and fuel line 24 before the radio signal is detected. Not only does this configuration prevent the incorrect type of fuel from being inserted into the vehicle 4, but such a configuration may also prevent misalignment of the nozzle 14 with the fuel tank opening 26. Therefore, a situation is realised whereby fuel may not be spilt onto the fuelling station forecourt or the like; the fuelling process may only commence when the fuel dispensing means 8 is correctly inserted into the fuel tank opening 26.

Figure 6:
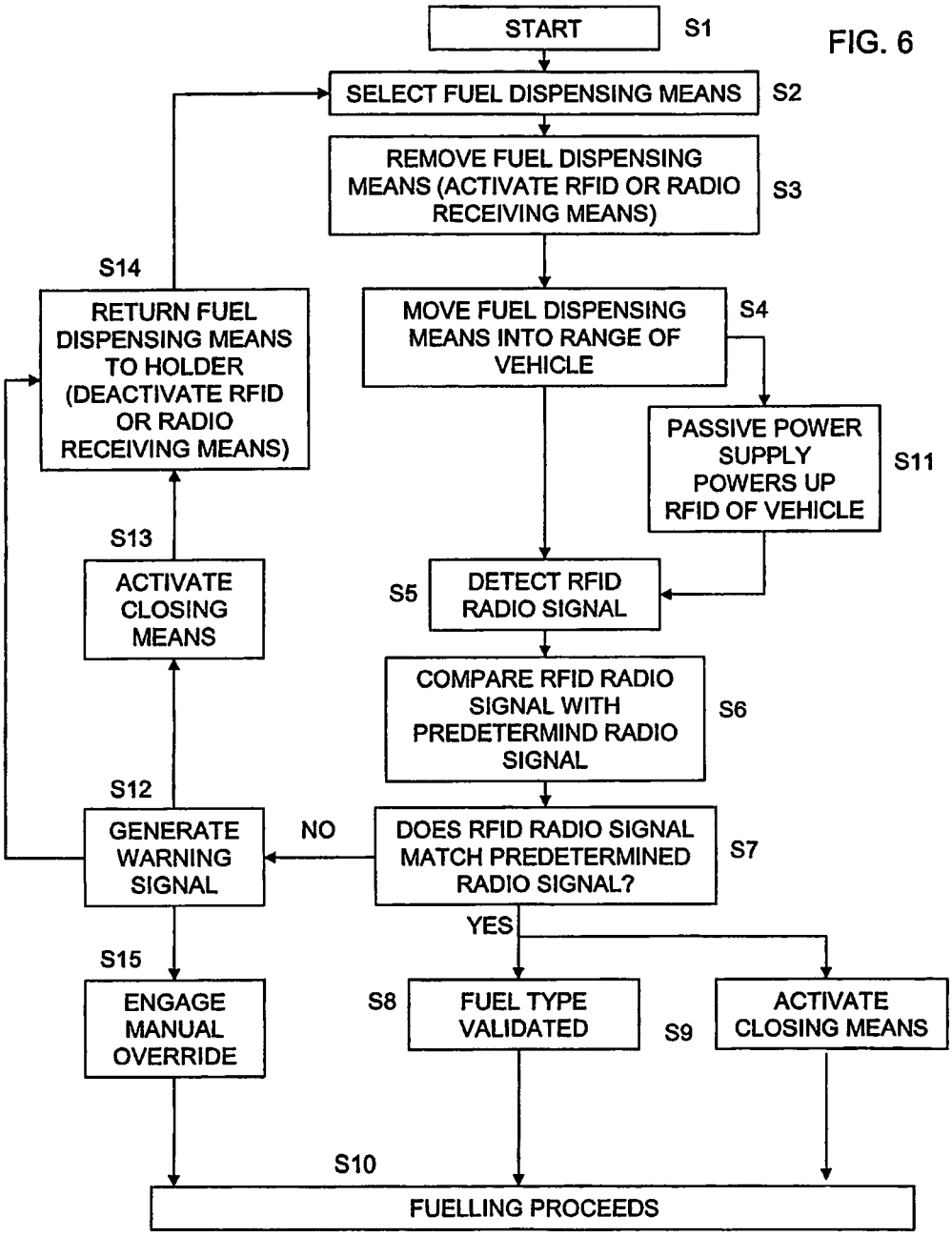
FIG. 6 shows an exemplary method for using the RFID tag and radio receiving means.

FIG. 6 describes a typical operational method for the arrangement described above. FIG. 6 also includes a plurality of optional features which may or may not take place in addition to the required steps, as discussed below. The method starts at step S1, wherein the vehicle 4 is already positioned in a correct fuelling position, i.e., in alignment with the fuel providing means 2, and the fuel filler cap 30 and stopper 32 have been removed from the fuel tank opening 26.

A user then selects a fuel dispensing means 8, at step S2, from the fuel providing means 2. This may include selecting only one type of fuel dispensing means 8, if only one is provided. Alternatively, this may include selecting one fuel dispensing means 8 from a plurality of fuel dispensing means 8, whereby typically each fuel dispensing means 8 supplies a different type of fuel. For example, a user may be faced with a choice of a plurality of fuel dispensing means 8 including a diesel, a petrol, and a biofuel dispensing means.

Once selected, the user may then remove the fuel dispensing means 8 from the holster 20, step S3, and move the fuel dispensing means 8 towards the vehicle 4, and more particularly, toward the fuel tank opening 26, step S4. At step S3, the removal of the fuel dispensing means 8 may activate certain elements of the fuel providing means 2. For example, and as is traditionally implemented, the removal of the fuel dispensing means 8 may activate a pump for pumping fluid fuel to the fuel dispensing means 8. Alternatively, the removal of the fuel dispensing means 8 may activate an alarm alerting the forecourt technician or a controller of the desire to operate the pump. The forecourt technician or controller may then manually activate the pump. In this sense, the controller may be a person or a computer implemented routine that controls the pumps for a plurality of the fuel providing means 2.

In addition, or alternatively, the removal of the fuel dispensing means 8 may activate the radio receiving means 42, via engaging or disengaging the switch provided in the holster 20 of the fuel providing means 2 (the switch being a part of the power providing circuit) thereby supplying the radio receiving means 42 with power, either from a battery or from a main power source, i.e., of the fuel providing means 2. At this point, of course, the radio receiving means 42 is in an activated state and is therefore able to detect the radio signal transmitted from the RFID tag 40.

A possible arrangement may be that the transmitting range R of the RFID tag 40 is large enough to cover the plurality of fuel dispensing means 8. In an inactive state, the radio receiving means 42 does not detect the radio signal, and a warning signal is not produced by the alarm unit 44. However, when the radio receiving means 42 is activated, potentially via an engagement or disengagement of the switch when removing the chosen fuel dispensing means 8, the radio signal is detected and a warning signal may or may not be produced. In this case, the fuel dispensing means 8 may not need to be moved very far from the holster 20, and thus may save the user considerable time when choosing the correct fuel dispensing means 8 for refuelling the vehicle 4. Alternatively, the transmitting range R may be small and thus the fuel dispensing means 8 requires some movement toward the RFID tag 40 before the radio signal can be detected.

Further, the passive power supply may also be activated when removing the fuel dispensing means 8, step S11. If the passive power range is set to be similar or the same as the transmitting range R of the RFID tag 40, then when the RFID tag 40 is powered up, the radio signal is emitted, and the radio receiving means 42 may detect such. That is, the passive power supply activates, which in turn activates the RFID tag 40 by supplying power via an electromagnetic interaction, which transmits the radio signal to the radio receiving means 42 (which is in range) and may, or may not, generate a warning signal via the alarm unit 44. Alternatively, the passive power range may be smaller than the transmitting range R. Here, the passive power supply must be moved close to the RFID tag 40 in order to activate the RFID tag 40. The advantages of the small transmitting range R discussed above, i.e., 20 cm or less, or 2 cm or less, are also realised in this configuration. That is, the transmitting range R may be larger than the passive power range but small enough not to interfere with the other fuel dispensing means 8 of the fuel providing means 2. Alternatively, the passive power range may be larger than the transmitting range R. In this case, the RFID tag 40 is powered up but the radio receiving means 42 must be brought closer to the RFID tag 40 in order to detect the radio signal. This avoids any shortcomings in the power-up time of the RFID tag 40, i.e., the delay between powering up and emitting the radio signal.

When the RFID tag 40 is activated, either passively or actively (via a battery/vehicle power supply), it emits the radio signal—which is indicative of the required fuel type for the vehicle 4. When the radio receiving means 42 is within the transmitting range R of the RFID tag 40, the radio signal is detected, step S5. In this case, the radio receiving means 42 must be located within the transmitting range R of the RFID tag 40 in order to detect the radio signal.

Step S6 involves the comparison of the radio signal with a predetermined radio signal which is carried out by determining means 43, wherein the predetermined radio signal is assigned to the fuel dispensing means 8 and is indicative of the type of fuel that fuel dispensing means 8 dispenses. That is, the predetermined radio signal is set to a specific frequency or type of signal that corresponds to the fuel dispensed. The determination of correspondence is made regarding how similar the radio signal and the predetermined radio signal are, i.e., do they match, step S7, by the determining means 43

The determination of correspondence may simply be a YES (the signals match) or a NO (the signals do not match) condition. Alternatively, or additionally, the determining means 43 may comprise logic means in order to compare the signals and account for errors. In this regard, the predetermined radio signal may include a plurality of signals or include a frequency band of acceptable radio signal frequencies or the like. In this case, the logic means is provided to establish whether or not the fuel dispensing means 8 dispenses the correct fuel by analysing and comparing the radio signal to the predetermined signal. This could include estimating an error (e.g., the frequency of the radio signal is within 10% of the frequency of the predetermined radio signal) or checking that the radio signal, or frequency thereof, lies in an acceptable frequency band. This may be particularly useful in a retrofit system or the like.

In the case of the radio receiving means 42 including the storage means 41 and determining means 43, the radio receiving means 42 compares the detected radio signal and determines the level of correspondence, which is then transmitted to the alarm unit 44. Conversely, if the alarm unit 44 possesses the storage means 41 and determining means 43, then the radio receiving means 42 simply transmits the radio signal to the alarm unit 44. If the alarm unit 44 is positioned remotely to the radio receiving means 42, then the radio receiving means 42 may be designed with a transmitter and/or an encoder or modulator. In this regard, the radio receiving means 42 may transmit the radio signal or determination of correspondence over a greater distance than the RFID tag 40, i.e., larger than the transmitting range R.

If the determination of correspondence is determined to be YES, then fuelling is allowed to proceed, step S10. Two possible options may be realised. Firstly, no action may be taken and the fuel dispensing means 8 is determined as being valid, step S8. That is, the fuel dispensing means 8 is determined to provide the correct type of fuel to the vehicle, and thus the provision of the fuel from the fuel dispensing means 8 is allowed to proceed according to the standard fuelling procedure. In this configuration, no warning is generated and thus the user simply operates the fuel dispensing means 8 as appropriate; for example, by compressing the trigger 16. Fuel is therefore able to pass from the nozzle 14 of the fuel dispensing means 8 to the fuel tank 22 of the vehicle 4 via the fuel line 24. In this arrangement, the pump may or may not be activated prior to the compression of the trigger 16. In other words, the trigger 16 controls the flow of fuel to the vehicle 14, and may also include operation (i.e., activation) of the pump.

Optionally, a positive warning signal may be generated which activates a positive indicator in order to identify that the fuel type is correct, i.e., the correct fuel type for that vehicle. For example, the positive warning signal may include the activation of a green LED signalling that the fuel to be inserted is correct. Additionally, the positive warning signal may include any of the warning signals discussed above, produced via corresponding warning means or indicators.

Figure 7A:
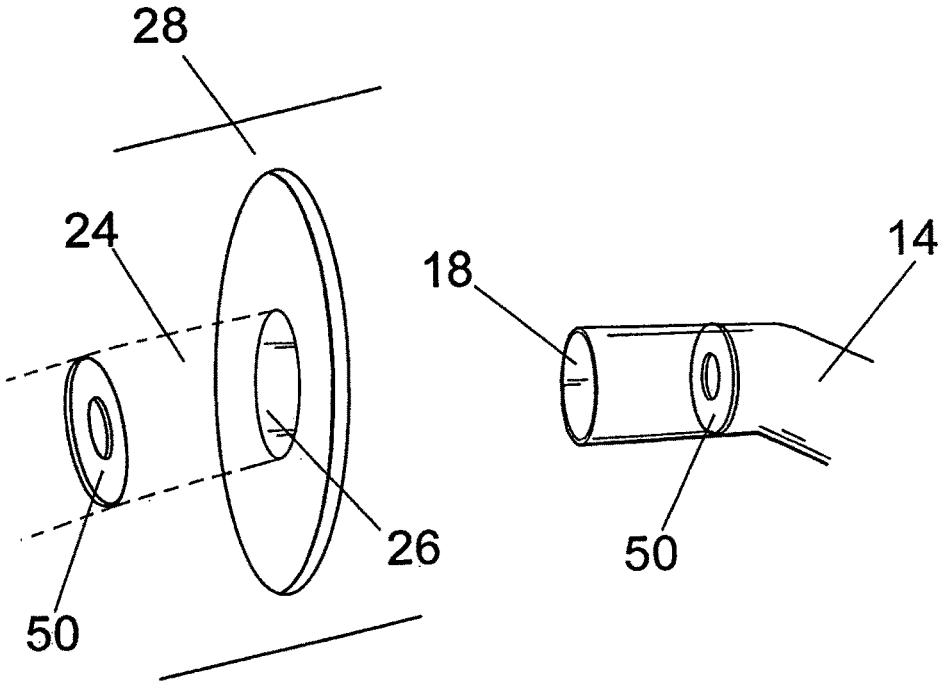
FIG. 7*a* shows two exemplary locations for closing means.

Alternatively, the fuel providing means 2 or the vehicle 4 may be optionally provided with closing means 50. The closing means 50 may comprise a physical component to block a fluid flow path, or may be a component adapted to switch off the pump of the fuel providing means 2. The closing means 50 may be positioned in a location along the flow path of the fuel. FIG. 7*a* illustrates two possible locations of the closing means 50. The closing means 50 may be located in the nozzle 14 of the fuel dispensing means 8 or in the fuel line 24 of the vehicle 4. The specific location is not limited, although preferably, the closing means 50 is positioned nearer the source of the fuel so as to prevent excessive travel of the fuel. Indeed, positioning the closing means 50 in the fuel line 24 may lead to some unwanted fuel entering the fuel system of vehicle 4.

Figure 7B:
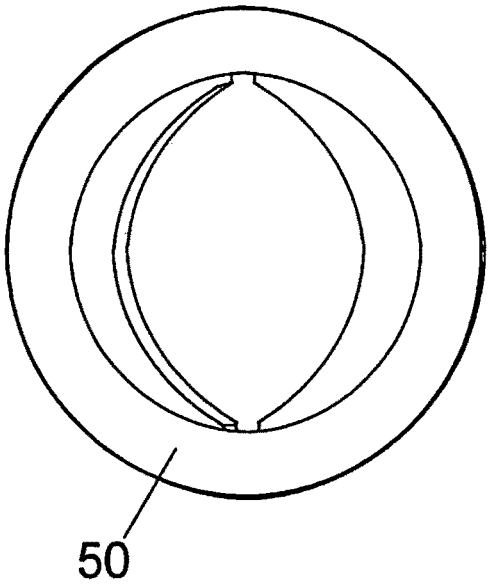
FIG. 7*b* shows a close-up view of an exemplary type of closing means.
Figure 8:
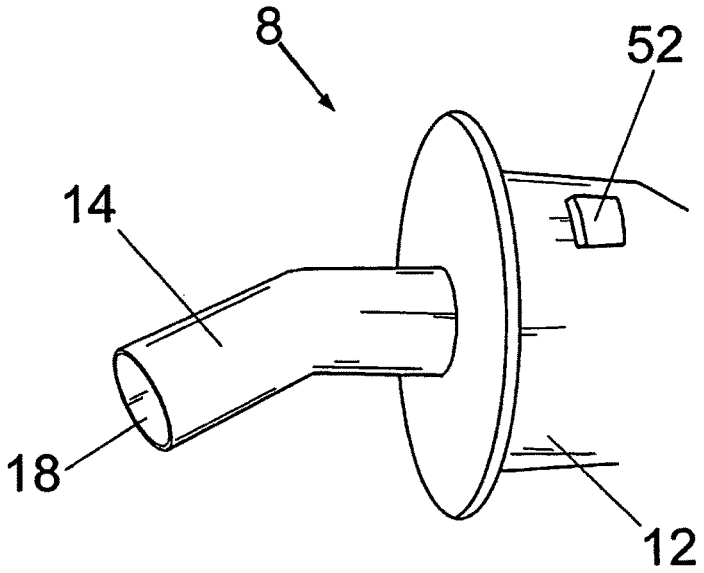
FIG. 8 shows an exemplary location for a manual override button.

The closing means 50 may include a valve or the like. FIG. 7*b* illustrates a butterfly valve or similar; however, the closing means 50 is not limited to a valve. For example, the closing means 50 may include a motor that is adapted to connect to and drive the fuel filler cap 30 and/or stopper 32. That is, the fuel filler cap 30 may be hinged to the vehicle 4 and closed and/or opened via operation of the motor thereby preventing or allowing the insertion of the nozzle 14 of the fuel dispensing means 8.

In this regard, a further arrangement is also contemplated whereby the fuel filler cap 30, including the closing means 50 comprising the motor, is configured to open when the correct fuel is detected. For example, the fuel filler cap 30 may be provided with radio receiving means 42 and the fuel providing means 2 may be provided with one or more RFID tags 40. When the vehicle 4, including the RFID tag 40, arrives at the fuel providing means 2, the correct radio signal may be detected from the fuel providing means 2 and thus opens the fuel filler cap 30. That is, the fuel filler cap 30 opens when the correct fuel dispensing means 8 is detected. This may provide a visual indication to the user that the vehicle is positioned at a fuel providing means 2 including the correct fuel dispensing means 8. Secondary radio signal detecting means may also be provided which may include the detection of a second radio signal from, for example, a second RFID tag 40, or may be based upon the strength of the received signal. That is, if a plurality of fuel dispensing means 8 are provided at a fuel providing means 2, when the vehicle 4 is within range of the correct fuel dispensing means 8, the fuel filler cap 30 is adapted to open. Then when the correct fuel dispensing means 8 is moved within a second range (corresponding to signal strength or a second RFID tag 40) then the pump or closing means 50 located in the fuel dispensing means 8 may activate or open.

The closing means 50 may be communicatively coupled to the alarm unit 44 or the determining means 43. The closing means 50 may also be physically connected to the alarm unit 44 or determining means 43, either via a wired connection or as an integrally formed part thereof. The closing means 50 may be activated in one of two ways. Following FIG. 6, the closing means 50 are provided in a closed state and open in response to a YES determination, step S9. Once opened, the fuelling proceeds via activation of the trigger 16. In some configurations, the signal sent to the closing means 50 based on a YES determination may be thought of as the positive warning signal described above, and may also include instructions for operating the positive indicator.

When a NO determination is made, i.e., the radio signal and predetermined radio signal do not match, a warning signal is generated, step S12. The warning signal is typically generated by the alarm unit 44 in response to the NO determination. As discussed above, the output of the alarm unit 44, and thus the warning signal, may include any number of indicative responses, including a visual signal, a sound based signal and/or a vibration based signal.

Essentially, the alarm unit 44 activates the required indicators by generating instructions for these indicators to operate based on the determination of correspondence by the determining means 43. The activation of the indicators then comprises the warning signal. The indicators may not all be required, and different conditions may require different indicators. For example, the warning signal may only comprise activation of a visual indicator 46 when petrol of different octane ratings are inserted into a petrol powered vehicle 4, and the warning signal may comprise a sound generated by the noise indicator 48 when diesel is selected to be inserted into a petrol powered vehicle 4.

A user is therefore alerted to the fact that the selected fuel dispensing means 8 is not the correct fuel for the vehicle, and thus takes the appropriate action by returning the nozzle 14 to the holster 20, step S14. The process then returns to step S2 and repeated until the correct fuel dispensing means 8 is selected. When returned to the holster 20, the radio receiving means 42 and/or RFID tag 40 may be deactivated, via activation of the switch located in the holster 20.

Additionally, or alternatively, the closing means 50 may be operated to close in response to the warning signal, step S13. That is, the alarm unit 44 may output a warning signal which includes the closing of the closing means 50. In this state, the closing means 50 are initially open and then closed, in contrast to the closing means 50 discussed in relation to step S9. The closing means 50 may also include means adapted to turn off/on the pump of the fuel providing means 2. That is, a separate means to turn off/on the pump other than the switch provided in the holster 20. A combination of the physical closing means 50 and instructions to turn off/on the pump may also be provided.

Additionally, or alternatively, the fuel dispensing means 8 or the vehicle 4 may be provided with a manual override button 52 or the like. In FIG. 7, a manual override button 52 is shown on the handle 12 of the fuel dispensing means 8, although the location of the manual override button 52 is not limited thereto. The manual override button 52 is provided such that the user may select to insert the fuel from the fuel dispensing means 8 even when the radio signal and the predetermined radio signal do not match. This may be as a result of a system failure or malfunction, or simply that the user wishes, for example, to insert biofuel instead of the standard fuel type. When pressed, step S15, the manual override button 52 allows fuelling to commence in response to the action of the trigger 16. Alternatively, the trigger 16 may be used as the manual override button 52, such that even when the warning signal is present, the trigger 16 controls the flow of fuel.

The above arrangements are described according to the arrangement of an RFID tag 40 placed on (or integrally formed with) a vehicle 4 and the radio receiving means 42 placed on or integrally formed with the fuel providing means 2. However, a further arrangement may be realised wherein the RFID tag 40 is disposed on (either integrally formed with or affixed to) the fuel providing means 2, and the radio receiving means 42 disposed on (either integrally formed with or affixed to) the vehicle 4. As above, the alarm unit 44 may be disposed (either integrally formed with or affixed to) on either of the vehicle 4 or the fuel providing means 2. Additionally, the storage means 41 and determining means 43 may be integrally formed with or affixed to the vehicle 4 or fuel providing means 2, and are provided with communicating means to communicate with the alarm unit 44 and radio receiving means 42, in addition to each other.

In such an arrangement, the operating principles of the above described arrangement are similar, if not identical. In this case, the RFID tag 40 of the fuel providing means 2 is powered up, potentially via activation of the switch, (either via a battery or main power, for example), and transmits a radio signal. The radio signal is detected by the radio receiving means 42 located on the vehicle 4, wherein the radio receiving means 42 may be powered via a battery or a main power supply. Again, a determination is made and the alarm unit 44 generates the warning signal accordingly. In this case, the RFID tag 40 may be provided with a passive power supply, such that the radio receiving means 42 powers up when in range of the passive power supply. Alternatively, the radio receiving means 42 may comprise the passive power supply and power up the RFID tag 40 on the fuel dispensing means 8—this requires that the radio receiving means 42 located on the vehicle 4 is provided with a battery or linked to the power system of the vehicle 4.

As discussed above, the arrangements may be installed as integrally formed components or as retrofit components. One aspect of the present invention is to provide a simple and easy-to-fit retrofit system such that an unskilled user may apply the system, particularly to a vehicle, themselves.

A preferred arrangement of the invention provides a disk or sleeve such that the disk or sleeve may be engaged with the nozzle 14 of the fuel dispensing means 8 in a sliding manner. That is, the inner surface of the disk or sleeve is a similar or slightly larger diameter to the diameter of the nozzle 14. In this case, the disk or sleeve may be effectively rigid and slide over the nozzle 14 and then be affixed to the nozzle 14 via fixing means, such as adhesive or a pin, or the like. Alternatively, the disk or sleeve may not be rigid, and be formed of a rubber or plastic compound. In this configuration, the diameter of the disk or sleeve is formed to be slightly smaller than the diameter of the nozzle 14 such that the disk or nozzle is held in place by the rubber or plastic compound's natural elasticity.

The disk or sleeve may then be integrally formed with the RFID tag 40 or the radio receiving means 42, and may also include the alarm unit 44. Equally, the vehicle 4 is provided with the other one of the RFID tag 40 or radio receiving means 42, and may also include the alarm unit 44. As discussed above, the RFID tag 40 and radio receiving means 42 may be provided with any of the aforementioned power supplies. Preferably, the RFID tag 40 and/or alarm unit 44 are formed as part of the disk or sleeve, while the radio receiving means 42 is located on the vehicle 4. In this arrangement, the radio receiving means 42 is supplied with a passive power source capable of powering the RFID tag 40 as discussed above. Additionally, the passive power source may also power the alarm unit 44, and the warning means. Preferably, the radio receiving means 42 is linked to the power system of the vehicle 4, but it is understood that the radio receiving means 42 may also be provided with its own, separate battery.

A further preferred arrangement may also include the closing means 50 disposed on an end portion of the disk or sleeve. For example, the closing means 50 may include a flap disposed over the open end of the disk or sleeve such that the flap is able to close the fuel opening 18 of the nozzle 14. In this arrangement, the flap may initially be open and close in response to a NO condition, or the flap may initially be closed and open in response to a YES condition.

However, all of the above described systems may also be adapted to interact with vehicles 4 that do not comprise the opposing component. That is, for example, a vehicle without an RFID tag 40 must be able to acquire fuel from the fuel providing means 2.

In this scenario, a determination cannot be made, as no radio signal is received at the radio receiving means 42. Note that the same situation occurs should the RFID tag 40 malfunction or is no longer supplied with power. Therefore, the fuel providing means 2 must be in an active state throughout the operation of said fuel providing means 2. In other words, step S9 may not be provided. Hence, the closing means 50 are opened and fuelling is allowed to take place regardless of the determination of correspondence. In addition, a positive indicator may be provided and indicate that the correct fuel is to be inserted, as discussed above. If no radio signal is detected, then the positive indicator does not activate (a YES determination is not made), and thus the user is alerted to the fact that a component may have malfunctioned or is in need of replacing. In both cases, the manual override 52 may be provided and may activate either the pump and/or the flow of the fuel when pressed.

The above described arrangements may also be provided with a fail safe mechanism. The fail safe mechanism may include that of the closing means 50 as discussed above, such that the closing means 50 remain closed should no radio signal be detected. Therefore, when the radio signal is not detected, due to power failure or malfunction of the RFID tag 40 or the radio receiving means 42, fuelling cannot take place. Of course, this may be overridden by the, optional, manual override button 52.

Figure 9:
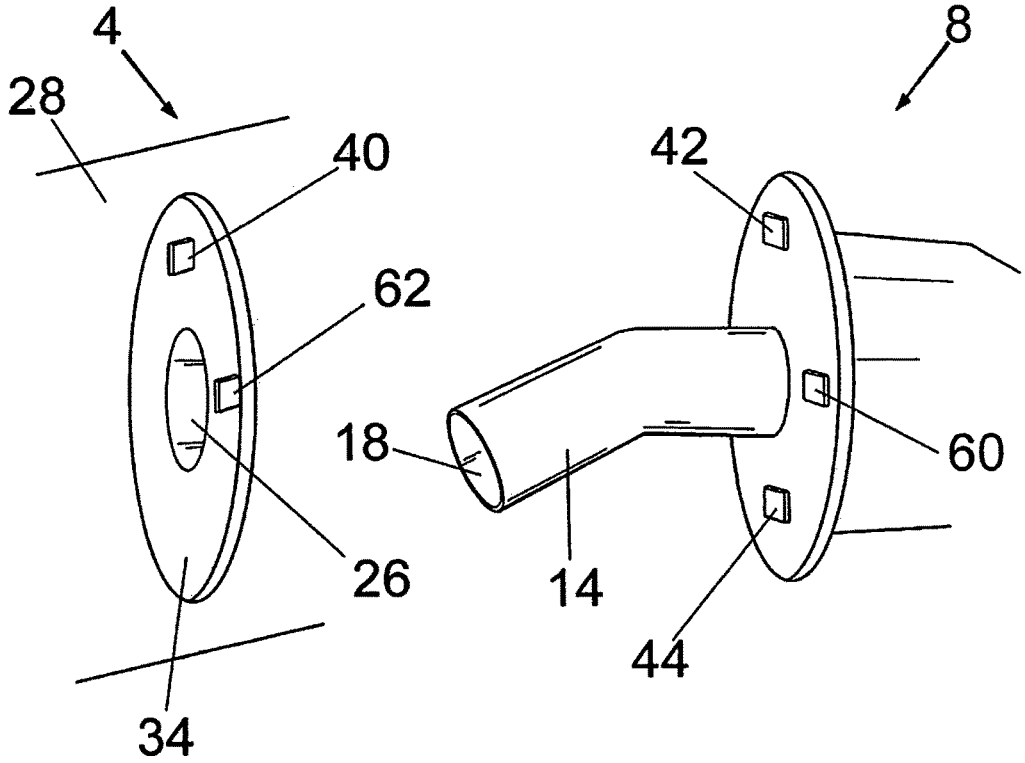
FIG. 9 shows a further exemplary arrangement using a plurality of RFID tags and radio receiving means.

Alternatively, or additionally, the arrangements may employ a plurality of RFID tags 40 and/or radio receiving means 42. FIG. 9 shows an exemplary arrangement using two RFID tags 40, 60 and two radio receiving means 42, 62. In the example shown, one of the radio receiving means 42 is positioned on the fuel providing means 2, while the other radio receiving means 62 is provided on the vehicle 4. Further, one of the RFID tags 60 is positioned on the fuel providing means 2, while RFID tag 40 is provided on the vehicle 4.

Any arrangement can be contemplated, and indeed the components do not have to be different on one of the vehicle 4 or fuel providing means 2. That is, both of the radio receiving means 42 and 62 could be located on the vehicle 4 or the fuel providing means 2 and both of the RFID tags 40 and 60 could be located on the vehicle 4 or the fuel providing means 2. Alternatively, only one radio receiving means 42 may be provided for a plurality of RFID tags 40, 60, wherein the one radio receiving means 42 detects all the radio signals from the plurality of RFID tags 40.

Essentially, the operation is similar to that described in the case of one RFID tag 40 and one radio receiving means 42. That is, the RFID tags 40, 60 emit a radio signal corresponding to the correct fuel type for the vehicle 4 or fuel that the fuel dispensing means 8 provides.

In the case of a plurality of arrangements and/or RFID tags 40, 60, the determination step performed by the determining means 43 is different however. Essentially, a comparison is made between the predetermined radio signal and a plurality of received radio signals. The determining means 43 then receives a plurality of signals from the radio receiving means 42 (singular or plurality) and the predetermined radio signal from the storage means 41. A YES determination may be made if all the radio signals correspond to the predetermined radio signal. In an arrangement utilising more than two RFID tags 40, 60, a determination may be made on a relative percentage of matches. For example, a condition may be that such that when 80% of the received radio signals correspond to the predetermined signal, a YES determination is made. For this to operate, a standard must be in place wherein, for example, three RFID tags 40, 60 are disposed around the fuel tank opening 26, and thus one-third or two-thirds must be detected—this allows for two or one of the RFID tags 40, 60 to fail and not affect the refuelling process.

This greatly enhances the chances that a fuel is not inserted in error, simply because the error associated with each RFID tag 40 and receiving means 42 is taken into account. Therefore, should one RFID tag 40 fail or malfunction, the correct refuelling may still take place.

For a plurality of RFID tags 40, 60, the predetermined radio signal may include a plurality of predetermined radio signals. That is, the predetermined radio signal may comprise two or more predetermined radio signals corresponding to different frequencies. For example, RFID tag 40 and radio receiving means 42 of FIG. 9 may operate at a frequency f1, and RFID tag 60 and radio receiving means 62 of FIG. 9 may operate at a frequency f2. In this case, the determining means 43 receives a plurality of radio signals (from the one or more radio receiving means 42) and a plurality of predetermined radio signals (from one or more storage means 41) and a YES determination is made if the frequency of the radio signal from RFID tag 40 matches f1 and the frequency of the radio signal from RFID tag 60 matches f2. In this example, the fuel supplied by the fuel dispensing means 8 or the fuel required for the vehicle 4 is actually represented by two pieces of data, f1 and f2.

This arrangement greatly enhances the chances that a fuel is not inserted in error, as both f1 and f2 must be present in order to identify the fuel. This helps to avoid any chances of interference from other RFID tags 40, 60 in determining a YES condition. Of course, only one radio receiving means 42 may be provided which detects all the radio signals and only one storage means 41 may store all the predetermined radio signals. That is, the radio receiving means may detect f1 and f2 and the determining means 43 compares these radio signals with corresponding predetermined radio signals, i.e., corresponding to f1 and f2 in this case. As discussed above, the comparison and/or storage of the predetermined radio signals may be in, or performed in, a remote location or in the alarm unit 44.

As discussed above, the RFID tag 40 and radio receiving means 42 may be provided as retrofit components adapted to be fixed to the vehicle 4 and/or the fuel providing means 2. Additionally, the RFID tag 40 or radio receiving means 42 may be integrally formed with the fuel filler cap 30 and/or stopper 32. A retrofitting system may also be realised with the integrally formed components, wherein a kit of a plurality of fuel filler caps 30 and/or stoppers 32 are provided. The kit includes fuel filler caps 30 and/or stoppers 32 of different sizes or with different hinge components such that they may be fitted to a plurality of different vehicles 4. Therefore, a mechanic or the like may replace the existing stock fuel filler cap 30 and/or stopper 32 with an integrally formed component from the kit.

Additionally, or alternatively, the kit may be provided with an alarm unit 44 integrally formed in the fuel filler cap 30 and/or stopper 32. The alarm unit 44 may be capable of communicating with the fuel providing means 2, and in a preferred arrangement, the radio receiving means 42 of the fuel providing means 2.

A programmable RFID tag 40 and/or storage means 41 may also be used in place of any of the RFID tags 40 or storage means 41 discussed above. Considering the arrangement of FIG. 2, the RFID tag 40 may be programmed to alter the radio signal; for example, in terms of frequency or modulation. When the storage means 41 is included in the vehicle 4, the storage means 41 may also be programmable so that the predetermined signal may be altered.

The advantages of providing a programmable RFID tag 40 and/or storage means 41 is that the fuel input to the vehicle 4 may be changed. For example, a vehicle 4 may have an integrally formed RFID tag 40 or storage means 41. The vehicle 4 may also have recently upgraded the engine or motor, and now requires a different fuel to run thereon. Rather than replace the whole fuel system of the vehicle 4, a user may simply reprogram the necessary components and avoid excessive maintenance or replacement work. Alternatively, the radio signal identification frequencies may be different from country to country and thus when travelling abroad, the RFID tag 40 or storage means 41 may need to be reprogrammed to accept the correct fuel. A display may also be provided so as to display a list of available predetermined radio signals corresponding to different types of fuel and/or to display the current selected or set predetermined radio signal.

Figure 10:
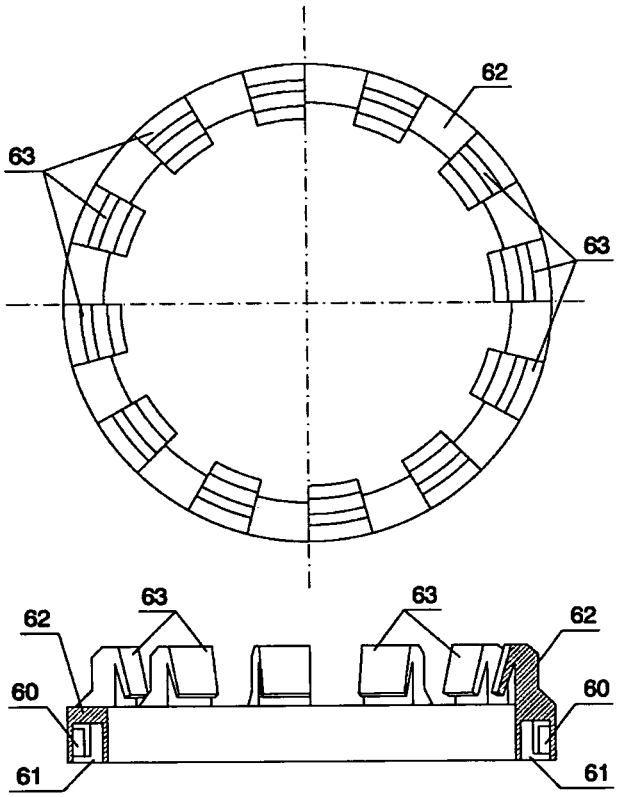
FIG. 10 shows an exemplary arrangement of an RFID tag fitted with a copper antenna housed in an internal circular enclosure.

FIG. 10 shows a particular embodiment in which the RFID tag 40 is placed in the vehicle and is fitted with a copper antenna 60 housed in an internal circular enclosure 61 and sealed in a rubber compound 62. This circular antenna 60 configuration presents the advantage of improving the read-range between the RFID tag 40 and radio receiving means 42 provided in the fuel dispensing means 8. In fact, when the RFID tag 40 is placed on the surface 34 surrounding the fuel tank opening 26, as shown in FIG. 2, or in another point position as might be the fuel filler cap, the radio signal emitted, which has an approximately elliptical shape, may be badly directioned and its reception by the radio receiving means 42 made difficult. Providing the vehicle RF device with a circular shaped antenna 60, as proposed in this form of embodiment, makes a uniform radio signal possible in all directions thus enormously improving the read-range.

Preferably the copper antenna will be constructed by winding copper wire. The diameter of the copper wire to be used in manufacturing may vary between 0.05 mm y 0.5 mm, preferably between 0.10 mm y 0.2 mm (including enamel insulation). The number of turns depends on a multitude of factors, but at the conventional dimensions of the fuel tank openings and compensating for the metal in the tank neck, the number of turns will be between 220 and 260. The final objective is to achieve the adequate inductance of the coil, which should be preferably of approximately 7.7 mH (milliHenry)

In order to boost the signal strength between the RFID tag 40 disposed on the vehicle and the radio receiving means 42 provided in the fuel dispensing means 8, this radio receiving means 42 may also be fitted with a copper antenna (not shown). For this unit disposed on the fuel dispensing means 8, the inductance of the coil should be around 480 uH (microHenry) and the number of turns will be between 50 and 100 turns for the pump unit.

The internal diameters of the fuel tank openings 26 are standard, although the outside may vary from some vehicles to others, mainly depending on the systems used for locking the fuel filler cap 30. This means that, in a first embodiment, the diameter of the circular crown may vary to be able to adapt to the different types of tank openings 26 of the different vehicles. In any event, diameters will approximately vary between 60 and 90 mm. To avoid this "made-to-measure" type of crown in each vehicle make, the vehicle RF device enclosure will preferably be made in a flexible material, the rubber or similar type, to ensure a one-size-fits all with regard to installation on the fuel port.

This vehicle RFID device, circular in shape for fitting around the fuel port, has "grip-flaps" 63 attached on the inside area to facilitate permanent attachment to the fuel entry port of the vehicle. These flaps are a single directional type to enable the RF unit to attach easily to the fuel port but makes it impossible to remove from the fuel port without severing the circular vehicle RF device.

The RFID tag 40 will be positioned at a marked point on the device to ensure the tag is facing towards the nearest point where the nozzle would be inserted into the fuel port. This ensures a maximum read-range for the RF sensor reader.

Figure 11:
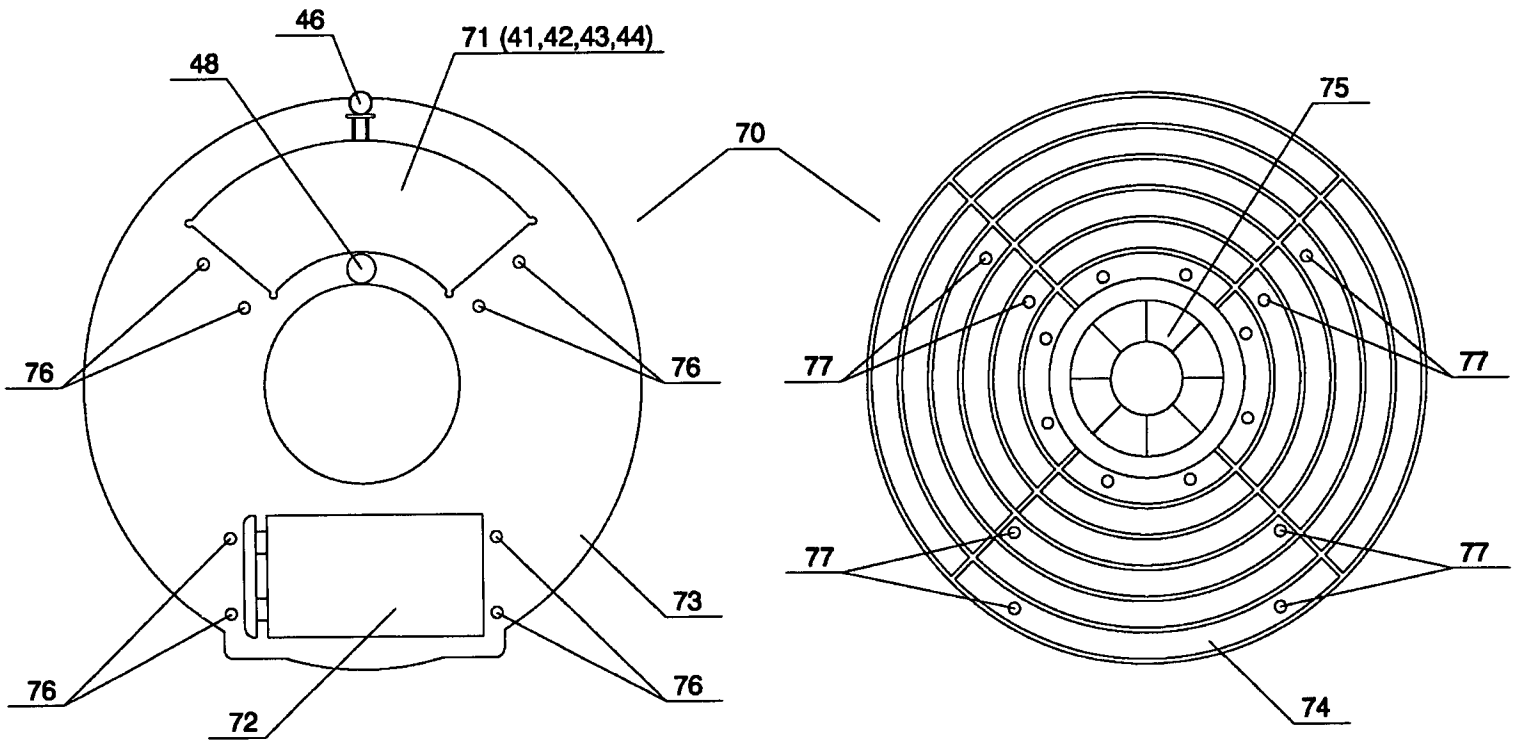
FIG. 11 shows an exemplary arrangement in which all electronic components are housed in a rubber splash-guard device.

FIG. 11 shows a particular embodiment in which all electronic components are housed in a rubber splash-guard device 70 adapted for mounting to the nozzle of a fuel pump. As shown in FIG. 11, a PCB board 71 is included on which are integrated the radio receiving means 42, the storage means 41, and the determining means 43. An alarm unit 44 is also included and, in this case, it consist of a dual audio-visual system comprising an acoustic signal produced by a buzzer 48 and a unit of warning LEDs as visual indicators 46. The rubber splash-guard device also includes a battery 72 for supplying power to the whole unit.

The number, colour, current and manner of activation (continuous or blinking) of the warning LEDs 46 is totally customizable. As far as the acoustic alarm is concerned, provision has also been made for the audio buzzer 48 decibel rate to be programmable.

In the case shown in this example, the rubber splash-guard device 70 is configured from two components 73-74 joined together and sealed to weatherproof and ensure compliance with safety standards. The first of these components 73 includes the housings required for housing the battery 72, the PCB Board 71 and the alarm devices (i.e. visual signalling LED 46 and buzzer 48 or acoustic alarm). The second component 74 performs the function of a cap to hold and protect the elements housed in the first component and also includes the means for securing the splash-guard device to the nozzle 14. In the specific case reflected in the figure, these means are flexible flanges 75 although other means suited to such purpose may be used.

Both components are releasably attached to each other. In the case shown in the figure, the join is made with a coupling system such that the first component 71 is provided with housings or holes 76 into which spigots 77 are inserted matching the housings or holes in the first component. Nevertheless, any other method of securing between the two components is valid. Whatever the system for joining both components may be, what must always be guaranteed is some type of aperture to be able to replace the battery 72.

Alternatively, the splash-guard device 70 could be configured as a single component integrating all the components indicated which only provides for a cap for accessing the battery 72 in order to replace it.

In a further embodiment the splash-guard device 70 is configured as an completely hermetically sealed unit, where the battery would not be replaced but rather be replaced by another unit when the battery life is expiring.

This splash-guard device 70 will be preferably circular shaped although any type of configuration is not discarded, provided the size and shape allow it to be used in the conventional holsters 20 of the fuel providing means 2.

As to materials, rubber is considered to be especially advantageous, although the use of any other type of material is not excluded provided it complies with the special safety requirements of this type of device for supplying fuel. It is also envisage that the internal components of the splash-guard device 70 would be micro-spayed with silicon or other type of humidity reduction process.

The splash-guard electronics are activated by a tilt-switch mechanism which turns on the power supply when the nozzle is removed from the holster 20 provided in the fuel providing means 2. The energy consumption of the devices is optimized in this way and, therefore, the useful life of the batteries is increased since it is not permanently activated but only when the nozzle is going to be used.

Once the nozzle has been removed from the holster and the electronics of the device are activated, the system starts polling or searching for the passive tag located on the vehicle at an intermittent RF sensor tag read-rate. A sensor tag read-rate of 10 to 30 times per second, preferably of approximately 15 times per second, is deemed to be particularly advantageous.

The activation and use of the splash-guard electronics are also time controlled from the moment the tilt-switch activates the electronics. For example, when the nozzle 14 is removed from the fuel providing means 2, the user will have a maximum pre-set time (e.g., up to 20 seconds) to insert the nozzle 14 into the fuel port before de-activation occurs. De-activation of the system must not be taken as the misfuelling prevention system simply stopping working but that the petrol pump overall will be locked and a warning alarm will be generated. Two objectives are achieved with this time control: One, specific to the system, which consists of optimizing the battery consumption of the device and the second, more general, of safety for the petrol filling up process itself.

Finally, in this form of embodiment, an alarm system has been provided to warn when the battery 72 is becoming low on power. This alarm system may use any of the audio-visual means mentioned (i.e., warning LEDs 46 and/or buzzer 48 activation). Preferably, the System will give a warning approximately one or two weeks in advance when it detects that the battery commences to lose power.

The present invention has therefore been provided in light of the need to provide a safe and reliable determination method for identifying the correct fuel to be inserted into a vehicle 4, thereby preventing misfuelling. The invention provides a contact free system, which may be adapted to be free of any interference, and equally does not interfere with existing wireless systems used at a fuelling station; primarily, due to the short ranges of the RFID tag 40. A human input or choice is reduced, thereby resulting in a more reliable, easy to use, and safer system.

The invention claimed is:

1. An apparatus for transferring data between a fuel providing means and a vehicle for the prevention of misfuelling, comprising:

an RFID tag, adapted to emit a radio signal, disposed on one of the vehicle and the fuel providing means;

a radio receiving means, disposed on the other one of the vehicle and the fuel providing means, adapted to detect the radio signal emitted by the RFID tag;

storage means for storing a predetermined radio signal;

determining means for comparing the detected radio signal with the predetermined radio signal and determining a correspondence; and an alarm unit, wherein the alarm unit is adapted to generate a warning signal on the basis of the correspondence, wherein the detected radio signal and the predetermined radio signal are each representative of a type of fuel, a switch provided in a holster of the fuel providing means, the switch provided in a power providing circuit that provides power to at least one of the RFID tag and the radio receiving means disposed on the fuel providing means, such that the switch is adapted to control the supply of power to one of the RFID tag and the radio receiving means.

2. The apparatus of claim 1, wherein the RFID tag is disposed on one of a surface adjacent a fuel tank opening of the vehicle and a fuel dispensing means of the fuel providing means, and is either integrally formed with the fuel providing means and vehicle, or is attachable to the fuel providing means and vehicle; and the radio receiving means is disposed on the other of the surface adjacent the fuel tank opening of the vehicle and the fuel dispensing means of the fuel providing means, and is either integrally formed with the fuel providing means and vehicle, or is attachable to the fuel providing means and vehicle.

3. The apparatus of claim 1, wherein the RFID tag is disposed on the vehicle and is fitted with a copper antenna housed in an internal circular enclosure and sealed in a rubber compound.

4. The apparatus of claim 3, wherein the RFID tag has single directional type grip-flaps attached on an inside area.

5. The apparatus of claim 1, wherein the radio receiving means is disposed on the fuel providing means and is fitted with a copper antenna.

6. The apparatus of claim 1, wherein the alarm unit is adapted to generate a warning signal which is one of: a visual based signal; a sound based signal; a visual and sound based signal; a vibration signal; a visual and vibration based signal; a sound and vibration based signal; and a visual, sound, and vibration based signal.

7. The apparatus of claim 1, wherein the alarm unit is provided with closing means and the warning signal further comprises a signal adapted to activate said closing means, the closing means adapted to at least one of:

a) close a fluid path between the fuel providing means and the vehicle, wherein the closing means includes at least one of a closing means located in the fluid path of the fuel dispensing means, and a closing means located in the fluid path of the vehicle; and b) switch off a pump of the fuel providing means.

8. The apparatus of claim 1, wherein the RFID tag is provided with a battery.

9. The apparatus of claim 1, wherein the radio receiving means further comprises a passive power source, the passive power source adapted to provide power to the RFID tag via an interaction between the RFID tag and the passive power source when the passive power source is in range of the RFID tag.

10. The apparatus of claim 1, further comprising fail safe means adapted to prevent the exchange of fuel between the fuel providing means and the vehicle if no radio signal is detected by the radio receiving means, wherein the fuel providing means is adapted to switch from a deactivated state to an activated state when the detected radio signal and predetermined radio signal correspond.

11. The apparatus of claim 1, further comprising a manual override button, wherein the manual override button, when activated, is adapted to allow the transfer of fuel from the fuel providing means to the vehicle regardless of the correspondence.

12. The apparatus of claim 1, wherein the radio receiving means, the storage means, the determining means and the alarm unit are housed in a splash-guard device adapted for mounting to the nozzle of a fuel pump.

13. The apparatus of claim 1, wherein either the RFID tag or the radio receiving means is disposed on a fuel station component comprising a fuel dispensing means.

14. The apparatus of claim 1, wherein either the RFID tag or the radio receiving means is disposed on a vehicle component comprising a fuel tank opening of the vehicle.

15. The apparatus of claim 1, wherein either the RFID tag or the radio receiving means is disposed on a fuel filler cap suitable for retrofitting to an arbitrary vehicle.

16. A method for the transfer of data between a fuel providing means and a vehicle for the prevention of misfuelling, comprising:

a storing step for storing a predetermined radio signal, the predetermined radio signal containing data representative of a type of fuel;

a transmitting step for transmitting a radio signal from at least one of the fuel providing means and the vehicle, the radio signal containing data representative of a type of fuel;

a detecting step for detecting the radio signal emitted by the at least one of the fuel providing means and the vehicle;

a determining step for determining the correspondence between the detected radio signal and the predetermined radio signal;

a warning step for generating a warning signal on the basis of the determining step; and a powering step for providing power by means of a switch provided in a holster of the fuel providing means, to at least one of the RFID tag and the radio receiving means, the switch being provided in a power providing circuit.

17. The method of claim 16, wherein, if the determining step determines that the detected radio signal corresponds to the predetermined radio signal, fuelling is permitted, and, if the detected radio signal is different from the predetermined radio signal, the warning signal is generated.

18. The method of claim 16, further comprising a closing means operating step, wherein the closing means operating step includes operating closing means in response to the warning signal, the closing means enabling at least one of:

a) closing of a fluid path between the fuel providing means and the vehicle, wherein the closing means includes at least one of a closing means located in the fluid path of the fuel providing means and a closing means located in the fluid path of the vehicle; and b) switching of a pump of the fuel providing means to an off state.

* * * * *